United States Patent [19]

Imatomi et al.

[11] 4,299,909

[45] Nov. 10, 1981

[54] SILVER HALIDE PHOTOGRAPHIC LIGHT-SENSITIVE MATERIAL

[75] Inventors: Eiji Imatomi; Kensuke Goda, both of Minami-ashigara, Japan

[73] Assignee: Fuji Photo Film Co., Ltd., Minami-ashigara, Japan

[21] Appl. No.: 175,987

[22] Filed: Aug. 7, 1980

[30] Foreign Application Priority Data

Aug. 7, 1979 [JP] Japan ..... 54/100593

[51] Int. Cl.[3] ..... G03C 5/30

[52] U.S. Cl. ..... 430/264; 430/306; 430/495; 430/510; 430/566

[58] Field of Search ..... 430/264, 306, 495, 510, 430/551, 437, 269, 566, 599, 607, 436

[56] References Cited

U.S. PATENT DOCUMENTS

| | | | |
|---|---|---|---|
| 2,592,368 | 4/1952 | Yackel | 430/264 |
| 2,685,510 | 8/1954 | Yackel | 430/264 |
| 2,751,295 | 6/1956 | Salminen et al. | 430/264 |
| 2,856,283 | 10/1958 | Yackel et al. | 430/264 |
| 3,143,414 | 8/1964 | Yackel et al. | 430/269 |
| 3,440,049 | 4/1969 | Moede | 430/264 |
| 3,639,126 | 2/1972 | Verelst | 430/264 |

OTHER PUBLICATIONS

Pontius, Photographic Science and Technique, PSA Journal, Section B, Sep. 1951, pp. 76–79.

*Primary Examiner*—Mary F. Downey
*Attorney, Agent, or Firm*—Sughrue, Mion, Zinn, Macpeak and Seas

[57] ABSTRACT

A silver halide photographic light-sensitive material providing wash-off relief images having high image density and excellent sharpness is described, comprising a support having thereon an antihalation layer, a silver halide photographic light-sensitive layer, and a hydrophilic colloid layer, said antihalation layer being located between said support and said silver halide photographic light-sensitive layer, wherein at least one silver halide light-sensitive layer or hydrophilic colloid layer contains a compound represented by the formula (I), a compound represented by the formula (II) and a compound represented by the formula (III)

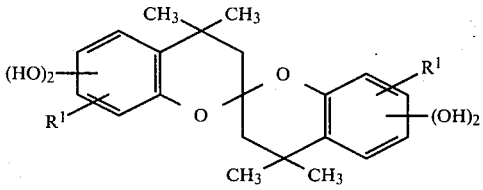

(I)

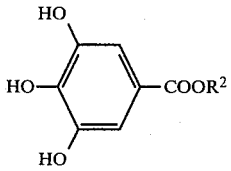

(II)

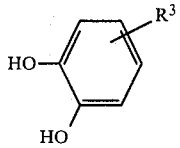

(III)

wherein $R^1$ represents hydrogen or a substituted or unsubstituted alkyl group; $R^2$ represents a substituted or unsubstituted alkyl group; and $R^3$ represents a substituted or unsubstituted alkyl group.

18 Claims, No Drawings

SILVER HALIDE PHOTOGRAPHIC LIGHT-SENSITIVE MATERIAL

BACKGROUND OF THE INVENTION

1. Field of the Invention

This invention relates to a silver halide photographic light-sensitive material containing a photographic tanning developing agent and, more particularly, to a silver halide photographic light-sensitive material which can provide wash-off relief images having a high image density and excellent sharpness.

2. Description of the Prior Art

In general, catechol, hydroquinone, pyrogallol, etc., have been known for a long time as so-called tanning developing agents which act as strong developing agents for photosensitive silver halides and form into oxidation products which react with a hydrophilic protective colloid, for example, gelatin, to tan it strongly. It has also been widely known to use these tanning developing agents in photographic emulsions or developers, as disclosed in U.S. Pat. No. 2,592,368. In the case of using tanning developing agents in developers, it is sometimes more difficult to obtain images having excellent sharpness as compared to using tanning developing agents in photographic emulsion layers, because the tanning developing agents are more likely to diffuse and move through silver halide emulsion layers during development. The image density obtained when the tanning developing agents are in the developers is less than when incorporated in the emulsion layers because the developing agents do not act sufficiently, and hence tanning of image areas is incomplete. As a result the tanned image areas may be partially dissolved in subsequent processing steps. Consequently, it is generally preferred, in obtaining so-called wash-off relief images, to incorporate tanning developing agents in the photographic materials rather than in the developers.

When water-soluble tanning developing agents such as pyrogallol and hydroquinone are incorporated in silver halide emulsion layers or layers adjacent thereto, the developing agents tend to have an undesirable effect on photographic properties. They may cause fogging upon storage of the photographic materials for a long period of time, a decrease in image density upon development as a result of a decrease in developing activity, and insufficient tanning. Also, when photographic materials prepared by coating a support with a silver halide photographic emulsion containing such a tanning developing agent are processed with an alkaline aqueous solution after light exposure, sometimes the developing agent is quickly lost in the alkaline solution, and hence a suitable silver images and sufficiently tanned images are not obtained.

Furthermore, because most tanning developing agents diffuse through coated gelatin layers, they can cause tanning of non-image areas. Therefore, to obtain preferred wash-off relief images with good photographic properties, tanning developing agents which have a strong developing activity, the oxidation products of which have a good tanning property, and which are stable for a long period of time when added to silver halide emulsion are needed. Moreover, to prevent tanning non-exposed areas, the diffusion speed of the developing agents in gelatin layers or gelatino silver halide emulsion layers should not be too high.

Further, in light-sensitive materials for obtaining wash-off relief images, an antihalation layer is sometimes provided between the support and the light-sensitive layer in order to improve sharpness of the images. In light-sensitive materials for obtaining wash-off relief images, a layer positioned between non-exposed areas of the light-sensitive layer and the support can be removed together with the light-sensitive layer during processing. However, when a layer positioned between exposed areas of the light-sensitive layer and the support is removed during processing the upper light-sensitive layer is also removed, and as a final result images cannot be obtained. Therefore, in light-sensitive materials having an antihalation layer between the support and the light-sensitive layer, and containing the same binder as that in the light-sensitive layer, it is necessary to tan not only the exposed areas of the light-sensitive layer, but also the antihalation layer positioned between said exposed areas and support.

Although various kinds of tanning developing agents have been disclosed, a tanning developing agent which satisfies the above-described requirements has not been developed. The dihydroxybiphenyl developing agents as described in U.S. Pat. No. 2,592,368 and the 4-phenylcatechol developing agents as described in U.S. Pat. No. 2,685,510 do not have the function of tanning the antihalation layer and so forth. Many kinds of developing agents are described in U.S. Pat. Nos. 3,143,414 and 2,751,295, however, specific developing agents which have the above-described function are not suggested.

SUMMARY OF THE INVENTION

Therefore, an object of the present invention is to provide a photographic light-sensitive material containing tanning developing agents which have a strong developing activity. And its oxidation products have a good tanning property on a hydrophilic protective colloid upon processing with an alkaline activator.

Another object of the present invention is to provide a photographic light-sensitive material containing tanning developing agents which can be stably incorporated into photographic emulsion layers or layers adjacent thereto.

Still another object of the present invention is to provide a photographic light-sensitive material which provides tanned images having excellent photographic properties while substantially suppressing the tanning of unexposed areas.

A further important object of the present invention is to provide a photographic light-sensitive material having an antihalation layer between a support and a light-sensitive layer thereof which provides wash-off relief images having excellent sharpness and high image density.

The above-described objects of this invention are attained by a silver halide photographic light-sensitive material comprising a support having thereon an antihalation layer, a silver halide photographic light-sensitive layer, and a hydrophilic colloid layer, said antihalation layer being located between said support and said silver halide photographic light-sensitive layer, at least one of said silver-halide light-sensitive layer and other hydrophilic colloid layers containing a compound represented by the formula (I), a compound represented by the formula (II) and a compound represented by the formula (III)

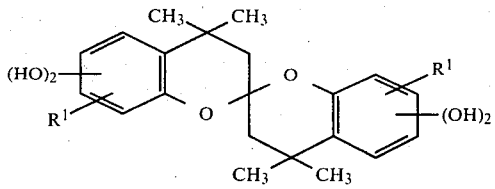

(I)

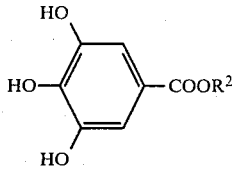

(II)

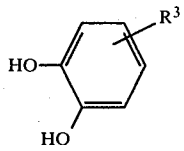

(III)

wherein $R^1$ represents hydrogen or a substituted or unsubstituted alkyl group; $R^2$ represents a substituted or unsubstituted alkyl group; and $R^3$ represents a substituted or unsubstituted alkyl group.

DETAILED DESCRIPTION OF THE INVENTION

Preferred examples of the alkyl groups represented by $R^1$ in the formula (I) are a methyl group, an ethyl group, a propyl group, a butyl group, a heptyl group, a hexyl group, a nonyl group, a decyl group, etc. The above-described alkyl groups may be straight chain or branched chain. The alkyl groups described above may be substituted by, for example, a halogen atom (e.g., a chlorine atom, a bromine atom, etc.), a hydroxy group, a carboxy group, an alkoxy group (preferably an alkoxy group having 1 to 4 carbon atoms), or a primary, secondary, or tertiary amino group, etc. Preferred examples of the substituents are a carboxy group, a hydroxy group or a halogen atom (e.g., a chlorine atom, a bromine atom, etc.), etc. However, of these alkyl groups, an unsubstituted or substituted alkyl group having from 1 to 5 carbon atoms is preferred for excellent solubility and photographic properties.

Preferred examples of the alkyl groups represented by $R^2$ in the formula (II) are the same as those of $R^1$ in the formula (I), but an alkyl group having from 2 to 5 carbon atoms is more preferred for excellent photographic properties and solubility, and an alkyl group having 3 carbon atoms is particularly preferred. The above-described alkyl groups may be substituted by the same as the substituents of $R^1$ in the formula (I). Preferred examples of the substituents are a carboxy group, a hydroxy group or a halogen atom, etc.

The alkyl groups represented by $R^3$ in the formula (III) may be straight chain or branched chain and preferably those having from 3 to 8 carbon atoms. Specific examples are a propyl group, a butyl group, a hexyl group, an octyl group, etc. Of these alkyl groups, an alkyl group having from 4 to 6 carbon atoms is particularly preferred. The alkyl groups described above may be substituted by, for example, a halogen atom (e.g., a chlorine atom, a bromine atom, etc.), a hydroxy group, a carboxy group, an alkoxy group (preferably an alkoxy group having from 1 to 4 carbon atoms), a sulfo group, an amido group, or a primary, secondary, or tertiary amino group, etc. Preferred examples of the substituents are an alkoxy group, a carboxy group or a halogen atom (e.g., a chlorine atom, a bromine atom, etc.), etc.

Examples of compounds represented by the formula (I) suitable for use in the present invention are illustrated below, although the invention is not limited to these compounds.

Compound (I-1)

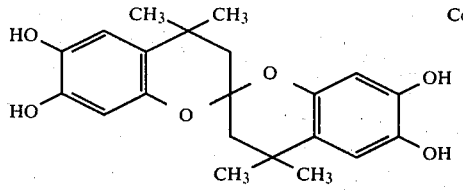

Compound (I-2)

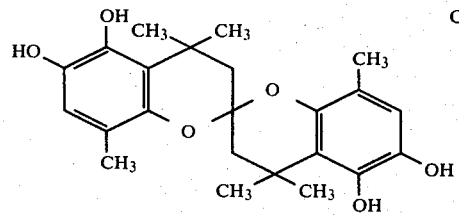

Compound (I-3)

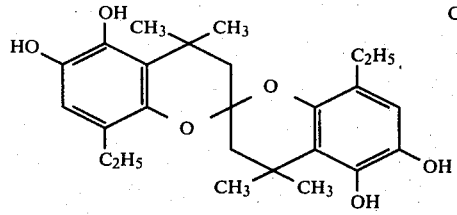

Compound (I-4)

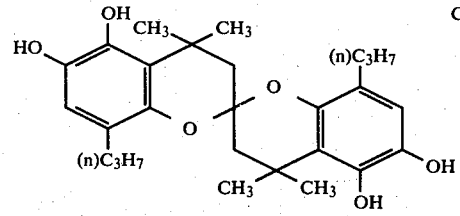

Compound (I-5)

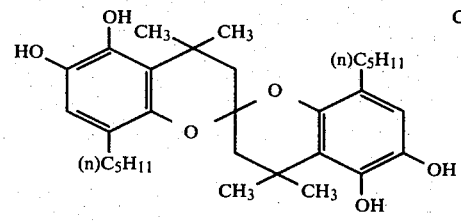

Compound (I-6)

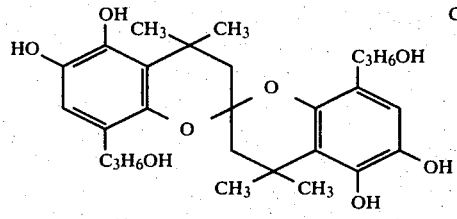

Compound (I-7)

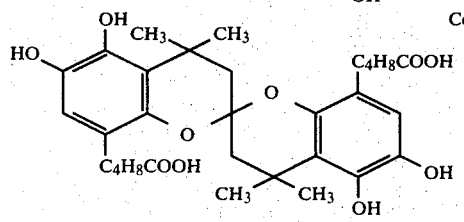

Preferred examples of the compound represented by the formula (II) are illustrated below. These examples are not to be considered as limiting.

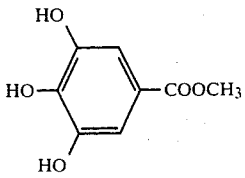

Compound (II-1)

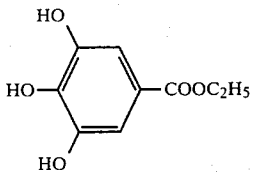

Compound (II-2)

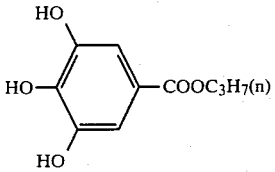

Compound (II-3)

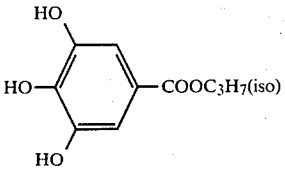

Compound (II-4)

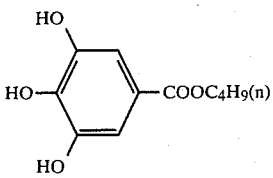

Compound (II-5)

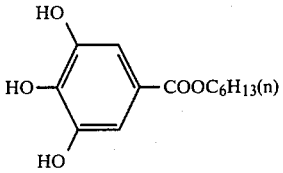

Compound (II-6)

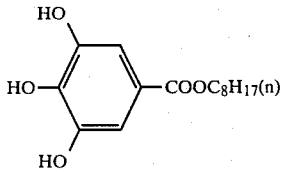

Compound (II-7)

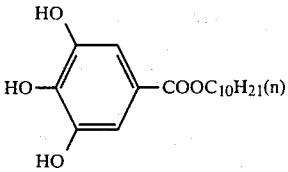

Compound (II-8)

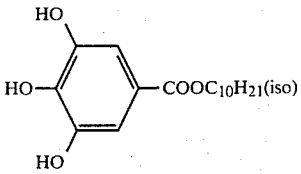

Compound (II-9)

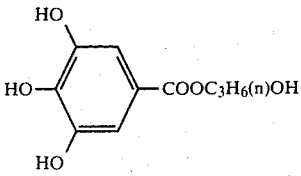

Compound (II-10)

-continued

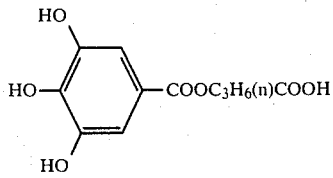

Compound (II-11)

Preferred examples of the compounds represented by the formula (III) are illustrated below. Again these examples are not to be considered as limiting.

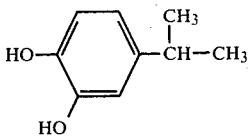

Compound (III-1)

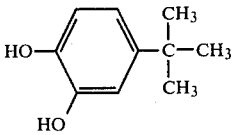

Compound (III-2)

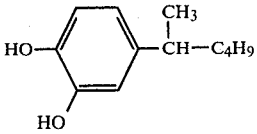

Compound (III-3)

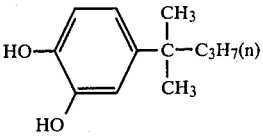

Compound (III-4)

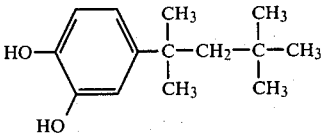

Compound (III-5)

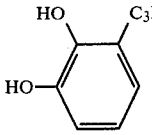

Compound (III-6)

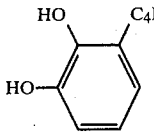

Compound (III-7)

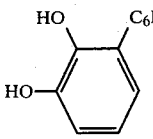

Compound (III-8)

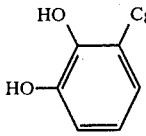

Compound (III-9)

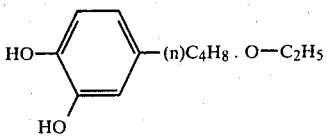

Compound (III-10)

-continued

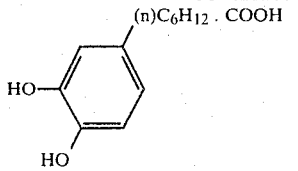

Compound (III-11)

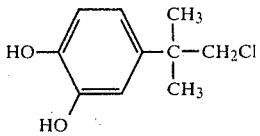

Compound (III-12)

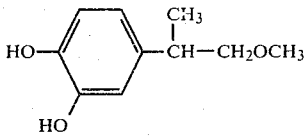

Compound (III-13)

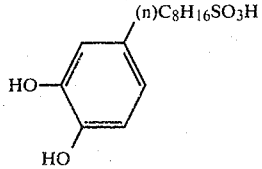

Compound (III-14)

The compounds represented by the formula (I) can be easily synthesized by methods similar to those used in synthesizing the polyhydroxy-spiro-bis-indane compounds described in U.S. Pat. No. 3,440,049 (1969). For obtaining the polyhydroxy-spiro-bis-chromans in a high yield by suppressing the conversion of them into the polyhydroxy-spiro-bis-indanes, it is important to keep the reaction temperature as low as possible, preferably at temperatures lower than about 100° C., and more preferably at lower than about 80° C.

To put it more concretely, the compounds can be synthesized by refluxing 2 mols of 1,2,4-trihydroxybenzene derivatives and 3 mols of acetone in the presence of a hydrochloric acid and an acetic acid.

The compounds represented by the formula (II) are well known, being widely used as antioxidants, for example, as additives to fats and oils or butter.

Of the compounds represented by the formula (III), compounds substituted with a straight chain alkyl group can be synthesized by catalytic reduction methods using the corresponding acyl compounds in the presence of a catalyst such as nickel or palladium, etc. Compounds substituted with a branched chain alkyl group can be synthesized by using catechol, an olefin corresponding to the desired substituent and sulfuric acid, hydrochloric acid, an ion exchange resin, activated clay, etc., as a catalyst.

These compounds can be stably incorporated in photographic materials or processing solutions. Furthermore, the compounds show good developing activity toward exposed silver halides and also have excellent tanning action for hydrophilic protective colloids, particularly gelatin. Therefore, gelatin, a hydrophilic colloid layer or silver halide emulsion layers tanned using the compounds of the formula (I), the formula (II), and the formula (III) used in this invention have a very high solubility resistance to an alkaline solution. Furthermore, since the compounds of the formula (I), the formula (II), and the formula (III) do not cause any interaction with other photographic additives coexisting with them, for example, anti-foggants, etc., the effects of such other photographic additives as well as the developing activity and this tanning activity of the developing agents are not reduced.

To disperse the compounds of the formula (I), the formula (II), and the formula (III) in a silver halide emulsion layer or layers adjacent thereto, alkali solutions of the compounds, neutralized as described in U.S. Pat. No. 3,440,049, may be used, or the compounds may be dispersed as solutions thereof in a water-soluble organic solvent such as cyclohexanone, acetone, methoxy ethanol, ethoxy ethanol, ethylene glycol, dioxane, dimethylformamide, and so forth. In another technique, the compounds can be dispersed as solutions in high boiling organic solvents such as are used in dispersing couplers as described in U.S. Pat. No. 3,676,137 (e.g., butyl phthalate, dinonyl phthalate, butyl benzoate, diethylhexyl sebactae, butyl stearate, dinonyl maleate, tributyl citrate, tricresyl phosphate, dioctylbutyl phosphate, trihexyl phosphate, trioctadecyl phosphate, etc.), or dispersed as solutions in diethyl succinate, dioctyl adipate, 3-ethylbiphenyl, etc. Furthermore, when dispersing the tanning developing agents solution as described above in a hydrophilic protective colloid solution, a surface active agent such as saponin, sodium alkylsulfosuccinate, sodium alkylbenzenesulfonate, etc., may also be used.

Preferably the compound represented by the formula (I) is incorporated in a photographic material in an amount of from about 0.01 to 1 mol per mol of silver (the expression "per mol of silver" or "/mol Ag" as used herein refers to silver content in the form of photosensitive silver halide), and preferably from about 0.02 to 0.3 mol per mol of silver. Also, it is preferred that the amount of the compound represented by the formula (II) incorporated in the photographic material be from about 0.005 to 0.1 mol per mol of silver, and preferably from about 0.01 to 0.1 mol per mol of silver. Furthermore, it is preferred that the amount of the compound represented by the formula (III) incorporated in the photographic material be from about 0.01 to 1 mol per mol of silver, and preferably from about 0.03 mol to 0.3 mol per mol of silver.

A typical example of a hydrophilic colloid used in the photographic materials of this invention is gelatin. Other examples are casein, carboxymethyl cellulose, polyvinyl alcohol, polyvinyl pyrrolidone, styrene-maleic anhydride copolymer, a condensate of styrene-maleic anhydride copolymer and polyvinyl alcohol, a polyacrylate, ethyl cellulose, etc., although the invention is not limited to these materials.

As the gelatin used for the photographic materials of this invention, so-called alkali-processed (lime-processed) gelatin obtained by immersing gelatin in an alkaline bath before extraction, acid-processed gelatin obtained by immersing gelatin in an acid bath, or enzyme-processed gelatin as described in *Bull. Soc. Sci. Photo. Japan,* No. 16, p. 30 (1966) may also be used. Furthermore, partially hydrolyzed low molecular weight gelatin obtained by heating a gelatin as described above in a water bath or by processing it with a proteolytic enzyme may be used.

The gelatin used for the photographic materials of this invention may, if desired, be partially replaced by colloidal albumin, casein, a cellulose derivative such as carboxymethyl cellulose, hydroxyethyl cellulose, etc.; a sugar derivative such as agar agar, sodium alginate, starch derivatives, etc.; or a synthetic hydrophilic colloid such as polyvinyl alcohol, poly-N-vinylpyrrolidone, a polyacrylic acid copolymer, polyacrylamide, and partially hydrolyzed products of these derivatives; as well as by so-called gelatin derivatives, i.e., gelatin modified by treatment with a reagent having a group capable of reacting with an amino group, an imino group, a hydroxy group, or a carboxy group in the gelatin molecule, or a graft polymer prepared by bonding a molecular chain of another polymer to gelatin.

Examples of reagents used in preparing the above-described gelatin derivatives are the isocynates, acid chlorides, and acid anhydrides described in U.S. Pat. No. 2,614,928; the acid anhydrides described in U.S. Pat. No. 3,118,766; the bromoacetates described in Japanese Patent Publication No. 5514/64; the phenylglycidyl ethers described in Japanese Patent Publication No. 26845/67; vinylsulfone compounds described in U.S. Pat. No. 3,132,945; the N-allylvinylsulfonamides described in British Pat. No. 861,414; the maleinimide compounds described in U.S. Pat. No. 3,186,846; the acrylonitriles described in U.S. Pat. No. 2,594,293; the polyalkylene oxides described in U.S. Pat. No. 3,312,553; the epoxy compounds described in Japanese Patent Publication No. 26845/67; the esters of acids described in U.S. Pat. No. 2,763,639; and the alkanesultones described in British Pat. No. 1,033,189.

Also, various branched polymers which are used in the above-described graft polymers of gelatin are described in, for example, U.S. Pat. Nos. 2,763,625, 2,831,767 and 2,956,884, *Polymer Letters*, 5, 595 (1967), *Phot. Sci. Eng.*, 9, 148 (1965), and *J. Polymer Sci.*, A-19, 3199 (1971) but polymers or copolymers of vinyl monomers such as acrylic acid, methacrylic acid, esters of these acids, the amide or nitryl derivatives of these acids, and styrene can be widely used. In particular, however, hydrophilic vinyl polymers having compatibility with gelatin to some extent, such as polymers or copolymers of acrylic acid, acrylamide, methacrylamide, hydroxyalkyl acrylate, hydroxyalkyl methacrylate, etc., are preferred.

The photosensitive silver halide emulsion layers or other hydrophilic colloid layers of the photographic materials of this invention may contain synthetic polymers such as, for example, latex-like water-dispersed vinylic polymers, and particularly polymers capable of increasing the dimensional stability of photographic materials solely or in admixture with other polymers, or as a combination of the above-mentioned polymer and a hydrophilic water-permeable colloid. These polymers are described in, for example, U.S. Pat. Nos. 2,376,005, 2,739,137, 2,853,457, 3,062,674, 3,411,911, 3,488,708, 3,525,620, 3,635,715, 3,607,290 and 3,645,740, and British Pat. Nos. 1,186,699 and 1,307,373. Among the polymers described in the above patents, homopolymers or copolymers of an alkyl acrylate, alkyl methacrylate, acrylic acid, methacrylic acid, sulfoalkyl acrylate, sulfoalkyl methacrylate, glycidyl acrylate, glycidyl methacrylate, hydroxyalkyl acrylate, hydroxyalkyl methacrylate, alkoxyalkyl acrylate, alkoxyalkyl methacrylate, styrene, butadiene, vinyl chloride, vinylidene chloride, maleic anhydride, and itaconic anhydride are generally used. When the polymers are prepared by the emulsion polymerization of these vinylic compounds, a so-called graft type emulsion-polymerized latex prepared in the presence of a hydrophilic protective colloid polymer may be used.

The photographic light-sensitive material of this invention may contain a matting agent. The matting agent used in such a case may be fine particles of a water-insoluble organic or inorganic compound having a mean particle size of from about 0.2 micron to 10 microns, and particularly from about 0.3 micron to 5 microns. Examples of the organic compound used as the matting agent are water-dispersible vinyl polymers such as polymethyl acrylate, polymethyl methacrylate, polyacrylonitrile, acrylonitrile-$\alpha$-methylstyrene copolymer, polystyrene, styrene-divinylbenzene copolymer, polyvinyl acetate, polyethylene carbonate, polytetrafluoroethylene, etc.; cellulose derivatives such as methyl cellulose, ethyl cellulose, cellulose acetate, cellulose acetate propionate, etc.; starch derivatives such as carboxy starch, carboxy-nitrophenyl starch, urea-formaldehyde-starch reaction products, etc.; gelatin hardened by a known hardening agent; and hardened gelatin in the form of fine hollow capsules obtained by the coacervation of gelatin. Examples of the inorganic compounds useful as the matting agent are silicon dioxide, titanium dioxide, magnesium dioxide, aluminum dioxide, barium sulfate, calcium carbonate, silver chloride or silver bromide desensitized by a known manner, and glass particles. The above-described matting agents may be used, if desired, in mixtures thereof.

For silver halide photographic emulsions of the photographic materials of this invention, known hardening agents such as, for example, aldehyde series compounds such as formaldehyde, glutaraldehyde, etc.; the compounds having a reactive halogen as described in U.S. Pat. No. 3,288,775, etc.; the compounds having a reactive ethylenically unsaturated bond described in U.S. Pat. No. 3,635,718, etc.; the aziridine compounds described in U.S. Pat. No. 3,017,280; the epoxy compounds described in U.S. Pat. No. 3,091,537, etc.; halogenocarboxyaldehydes such as mucochloric acid, etc.; dioxane compounds such as dihydroxydioxane, dichlorodioxane, etc.; divinylsulfone compounds or inorganic hardening agents such as chromium alum, zirconium sulfate, etc.; may be used at a concentration of less than about 20 wt% to dry gelatin. If desired, such a hardening agent may be omitted.

The silver halide emulsion used for the photographic materials of this invention is usually prepared by mixing an aqueous solution of a water-soluble silver salt (e.g., silver nitrate) and an aqueous solution of a water-soluble halide (e.g., potassium bromide) in the presence of an aqueous solution of a water-soluble polymer such as gelatin. As the silver halide, silver chloride, silver bromide as well as a mixed silver halide such as silver chlorobromide, silver iodobromide, silver chloroiodobromide, etc., can be used.

The form of the silver halide grains may be a cubic system, octahedron, or a mixed crystal system. There is no particular limitation on the grain size and mean grain size distribution of the silver halide grains and any type of silver halide grains can be used.

These silver halide grains are prepared in a conventional manner. As a matter of course, it is useful to employ a so-called single jet method, double jet method, control double jet method, etc., at the preparation of silver halide grains. Also, two or more kinds of silver halide photographic emulsions each prepared separately may be mixed for use.

Furthermore, the silver halide grains used in this invention may have a homogeneous crystal structure or a core/shell structure having different properties between the inner core and the outer shell of the grain. Also, the silver halide grains may be of so-called conversion type grains as described in British Pat. No. 635,841 and U.S. Pat. No. 3,622,318. They may be of a type in which the latent images are mainly formed on the surfaces thereof, or a type in which latent images are formed inside the grains. These photographic silver halide emulsions are described, for example, in T. H. James (Editor), *The Theory of Photographic Process,* 4th Edition, published by Macmillan Co., pp. 88–104 (1977), P. Grafikides, *Chimie Photographique,* published by Paul Montel (1957), etc., and may be prepared by various methods such as an ammoniacal method, a neutral method, an acid method, and so forth.

Silver halide grains thus-formed are washed with water to remove water-soluble by-product salts (e.g., potassium nitrate in case of preparing silver bromide using silver nitrate and potassium bromide) from the system and then heat-treated in the presence of a chemical sensitizer such as sodium thiosulfate, N,N,N'-trimethylthiourea, a thiocyanate complex salt of monovalent gold, a thiosulfate complex salt, stannous chloride, hexamethylenetetramine, etc., to increase their sensitivity without increasing their grain size. These methods are also described in the above references.

The silver halide emulsions described above can be chemically sensitized in an ordinary manner. Examples of the chemical sensitizers used in such cases are the gold compounds such as chloroaurates, gold trichloride, etc., described in U.S. Pat. Nos. 2,399,083, 2,540,085, 2,597,856 and 2,597,915, the salts of noble metals such as platinum, palladium, iridium, rhodium, ruthenium, etc., described in U.S. Pat. Nos. 2,448,060, 2,540,086, 2,566,245, 2,566,263 and 2,598,079, the sulfur compounds capable of forming silver sulfide by the reaction with silver salts described in U.S. Pat. Nos. 1,574,944, 2,410,689, 3,189,458 and 3,501,313, the stannous salts, amines and other reducing materials described in U.S. Pat. Nos. 2,487,850, 2,518,698, 2,521,925, 2,521,926, 2,694,637, 2,983,610 and 3,201,254, and other reducing materials.

The photographic silver halide emulsions used in this invention may be spectrally sensitized or supersensitized, if desired, using cyanine dyes such as cyanine, merocyanine, carbocyanine, etc., solely or as a combination thereof or as a combination of them with styryl dyes, etc. These dye sensitization techniques are well known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68, 14030/69 and 10773/68, U.S. Pat. Nos. 3,511,664, 3,552,052, 3,527,641, 3,615,613, 3,615,632, 3,617,295, 3,635,721 and 3,694,217 and British Pat. Nos. 1,137,580 and 1,216,203. These techniques are selected depending on the wavelength region, sensitivity, etc., and the purposes and uses of the photographic materials.

To the photographic silver halide emulsion described above various compounds may be added for preventing the occurrence of a reduction in sensitivity and formation of fog during the production, preservation or processing of the photographic materials. As such additives, a very large number of compounds have been known such as 4-hydroxy-6-methyl-1,3,3a,7-tetrazaindene, 3-methylbenzothiazole, 1-phenyl-5-mercaptotetrazole, as well as many heterocyclic compounds, mercury-containing compounds, mercapto compounds, metal salts, etc.

Practical examples of these additives are described in K. Mees, *The Theory of the Photographic Process,* 3rd Edition, pp. 344–349 (1966) as well as U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Pat. Nos. 893,428, 403,789, 1,173,609 and 1,200,188.

The photographic silver halide emulsions used in this invention may further contain one or more surface active agents. They are usually used as a wetting agent but, as the case may be, they are used for other purposes such as improving the emulsified dispersibility, sensitization, and photographic properties, or antistatic property and adhesion prevention. As these surface active agents, there are natural surface active agents such as saponin, etc.; nonionic surface active agents such as alkylene oxide series surfactants, glycerol series surfactants, glycidol series surfactants, etc.; cationic surface active agents such as higher alkylamines, quaternary ammonium salts, heterocyclic as pyridine, etc., phosphoniums, sulfoniums, etc.; anionic surface active agents containing acid groups such as carboxylic acid, sulfonic acid, phosphoric acid, sulfuric acid group, phosphoric acid ester group, etc.; and amphoteric surface active agents such as amino acids, aminosulfonic acids, and sulfuric or phosphoric esters of amino alcohol.

Examples of the surface active agents useful in this invention are described in, for example, U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, West German Patent Application (OLS) No. 1,942,665 and British Pat. Nos. 1,077,317 and 1,198,450 as well as Ryohei Oda et al., *Synthesis of Surface Active Agents and Application Thereof,* published by Maki Shoten, 1964, A. W. Bery, *Surface Active Agents,* published by Interscience Publication Incorporated, 1958, and J. P. Sisley, *Encyclopedia of Surface Active Agents,* Vol. 2, published by Chemical Publish Company, 1964.

In the antihalation layer used in the light-sensitive material of the present invention, it is preferred to use a binder which is tanned with an oxidation product of the developing agent in the same manner as the binder used in the photographic emulsion layer. As a light-absorbing substance thereof, carbon black, colloidal silver, the dyes described in *Research Disclosure,* No. 17643 (December, 1978), etc., can be used. When the antihalation layer between the exposed areas of the emulsion layer and support is tanned together with the emulsion layer, the layers are not removed by the processing. On the other hand, the antihalation layer between the unexposed areas of the emulsion layer and support is removed, together with the emulsion layer, by the processing. Therefore, it is not necessary to decolorize or dissolved out into the processing solution the light-absorbing substance present in the antihalation layer. On the contrary, when the light-absorbing substance remains in the antihalation layer corresponding to the exposed areas after the development processing, the image density is further increased. Accordingly, light-absorbing substance in the antihalation layer which is neither decolorized nor dissolved out into the processing solution by conventional black-and-white development processing such as carbon black or colloidal silver is preferred, in order to increase the image density.

The supports which are used in the light-sensitive material of the present invention are flat materials which are not subject to dimensional deformation during processing, for example, hard supports such as glass sheets, metal sheets, porcelains, etc., or flexible supports, according to the purpose of the photographic materials.

Typical examples of the flexible supports are those ordinarily employed for photographic materials, such as cellulose nitrate films, cellulose acetate films, cellulose acetate butyrate films, cellulose acetate propionate films, polystyrene films, polyethylene terephthalate films, polycarbonate films, laminates of these films, thin glass sheets, baryta-coated papers, papers laminated with a polymer of an α-olefin having from 2 to 10 carbon atoms, such as an α-polyolefin polymer, such as polyethylene, polypropylene or an ethylene-butene copolymer, and plastic films having improved adhesion to other polymers and improved printability by roughening the surfaces thereof, as described in Japanese Patent Publication No. 19068/72.

The supports used may be transparent or opaque according to the purpose of the photographic materials. Also, in the case of using transparent supports, they may be colorless, or may be colored, if desired, by addition thereto of dyes or pigments. This coloring technique is known in X-ray films, etc., and described in, for example, *Journal of the Society of Motion Picture and Television Engineers* (referred to *J. of S.M.P.T.E.*), Vol. 67, p. 296 (1958).

Opaque supports used in this invention include initially opaque supports such as papers, opaque films prepared by incorporating a pigment such as titanium oxide, etc., in transparent films, plastic films the surfaces of which have been treated by the method described in Japanese Patent Publication No. 19068/72, and papers, plastic films, etc., which have been rendered completely light shielding by adding thereto carbon black and/or dye. When the adhesion between a support and a photographic silver halide emulsion layer is insufficient, it has been attempted to form a layer which is adhesive to both the support and the emulsion layer as a subbing layer on the support. Also, for further improving the adhesion, a pre-surface treatment, such as corona discharge treatment, ultraviolet irradiation, flame treatment, etc., may be applied to the surface of the support.

Each photographic layer of the photographic materials of this invention may be coated by various coating methods, such as dip coating method, air knife coating method, curtain coating method, spray coating method, and extrusion coating method using the hopper described in U.S. Pat. No. 2,681,294. Furthermore, if necessary, two or more photographic layers can be coated simultaneously by the method described in U.S. Pat. Nos. 2,761,791, 3,508,947, 2,941,898, and 3,526,528.

The development used in this invention differs from a conventional black-and-white development only in that an alkali activator is used as the developing bath. The other steps are the same in the processes. The pH of the activator is from about 7 to 14, and preferably from about 12 to 14. The temperature of the activator solution is usually from 5° to 30° C., and preferably from 13° to 20° C.

The activator used in this invention is essentially a black-and-white developer from which the developing agent has been removed. The activator contains a buffer such as sodium hydroxide, potassium hydroxide, sodium carbonate, potassium carbonate, sodium tertiary phosphate, potassium tertiary phosphate, potassium metaborate, borax, etc., and they may be used alone or as a mixture. Also, for obtaining a further buffer function, for the convenience of the preparation of the activators or for increasing the ion strength, disodium hydrogenphosphate, dipotassium hydrogenphosphate, sodium dihydrogenphosphate, potassium dihydrogenphosphate, sodium hydrogencarbonate, potassium hydrogencarbonate, boric acid, an alkali nitrate, an alkali sulfate, etc., may be used.

Also, the activator may further contain an appropriate amount of fog-controlling agents. These compounds include inorganic halide compounds and known organic anti-fogging agents. Typical examples of the inorganic halide are bromides such as sodium bromide, potassium bromide, ammonium bromide, etc., and iodides such as potassium iodide and sodium iodide. On the other hand, examples of the organic anti-foggant are 6-nitrobenzindazole described in U.S. Pat. No. 2,496,940; 5-nitrobenzimidazole described in U.S. Pat. Nos. 2,497,917 and 2,656,271; diaminophenazine, o-phenylenediamine, mercaptobenzimidazole, methylbenzothiazole, mercaptobenzoxazole, thiouracil, and 5-methylbenzotriazole described in *J. the Soc. of Photo. Sci. and Tech. of Japan,* Vol. 11, p. 48 (1948); and the heterocyclic compounds described in Japanese Patent Publication No. 41675/71. Moreover, the anti-foggants described in *Kagaku Shashin Binran* (*Handbook of Scientific Photography*), Vol. 2, p. 119 (1959, published by Maruzen K.K.) can be also used in this invention.

To control development of the surface layer, the development inhibitors disclosed in Japanese Patent Publications Nos. 19039/71 and 6149/70 and U.S. Pat. No. 3,295,976 may be used.

Other additives, such as ammonium chloride, potassium chloride, sodium chloride, etc., may be added, if desired or necessary, to the activators used in this invention. Also, if desired or necessary, development accelerators can be added to the activator solution. Examples of such development accelerators include various pyridinium compounds and other cationic compounds described in U.S. Pat. No. 2,648,604, Japanese Patent Publication No. 9503/69 and U.S. Pat. No. 3,671,247; cationic dyes such as phenosafranine; neutral salts such as thallium nitrate and potassium nitrate; the nonionic compounds such as polyethylene glycol, the derivatives thereof and polythioethers described in Japanese Patent Publication No. 9504/69, and U.S. Pat. Nos. 2,533,990, 2,531,832, 2,950,970 and 2,577,127; organic solvent and the organic amines, ethanolamine, ethylenediamine, and diethanolamine described in Japanese Patent Publication No. 9509/69 and Belgian Pat. No. 682,862. Other examples of the accelerators are described in L.F.A. Mason, *Photographic Processing Chemistry,* pp. 40–43 (Focal Press, London, 1966).

Sodium sulfite, potassium sulfite, potassium hydrogensulfite, sodium hydrogensulfite, etc., may also be added to the activators used in this invention.

Furthermore, polyphosphate compounds exemplified by sodium hexametaphosphate, sodium tetrapolyphosphate, sodium tripolyphosphate, potassium hexametaphosphate, potassium tetrapolyphosphate, potassium tripolyphosphate, etc.; and aminopolycarboxylic acids exemplified by ethylenediaminetetraacetic acid, nitrilotriacetic acid, cyclohexanediaminetetraacetic acid, iminodiacetic acid, N-(hydroxymethyl)e-thylenediaminetriacetic acid, diethylene triaminepentaacetic acid, etc., may be used as a water softener. The amount thereof depends upon the hardness of the water used, but usually is from about 0.5 to 10 g/liter. In addition, a calcium or magnesium type masking agent can also be used. They are described in detail in J. Willems, *Belgisches Chemiches Industry,* 21, 325 (1956) and ibid., 23, 1105 (1958).

The invention will further be described by the following example.

EXAMPLE

Samples A, B, C, D and E were prepared in the following manner.

SAMPLE A

A silver halide emulsion containing 60 g of gelatin and 1.1 mols of silver chlorobromide (30 mol% silver bromide) in 760 g of water was prepared. The mean grain size of the silver chlorobromide grains was 0.4 micron. After removing the soluble salt by-product in a conventional manner, the silver halide emulsion was chemically sensitized by the addition of sodium thiosulfate. The following materials were added to the silver halide emulsion.

| | |
|---|---|
| Saponin (6% aq. soln.) | 20 g |
| Dispersion (a) prepared in the manner described below | 500 g |

Dispersion (a) was prepared by mixing Composition (a-1) and Composition (a-2), having the following compositions, and stirring vigorously.

| | |
|---|---|
| Composition (a-1) | |
| Compound (III-2) | 17 g |
| Compound (I-1) | 3 g |
| Compound (II-4) | 7 g |
| Tricresyl Phosphate | 18 g |
| Ethyl Acetate | 25 g |
| Composition (a-2) | |
| Gelatin | 25 g |
| Water | 380 g |
| Saponin (6% aq. soln.) | 25 g |

Also, a composition for an antihalation layer having the following composition was prepared.

| | |
|---|---|
| Gelatin | 40 g |
| Carbon Black | 15 g |
| Water | 1 l |

On a subbed polyethylene terephthalate film, the composition for the antihalation layer thus-prepared was coated at a coating amount of carbon black of 0.1 g/m$^2$ and then the silver halide emulsion described above was coated at a coating amount of silver of 3 g/m$^2$ to prepare Sample A.

SAMPLE B

In place of Dispersion (a) which was added to the emulsion of Sample A, Dispersion (b), which was prepared by mixing Composition (b-1) and Composition (b-2) (having the compositions described below) and vigorously stirring, was added to the silver halide emulsion as in Sample A.

| | |
|---|---|
| Composition (b-1) | |
| Compound (III-2) | 20 g |
| Compound (II-4) | 7 g |
| Tricresyl Phosphate | 18 g |
| Ethyl Acetate | 25 g |
| Composition (b-2) | |
| Gelatin | 25 g |
| Water | 380 g |
| Saponin (6% aq. soln.) | 25 g |

In the same manner as described in Sample A, except using the emulsion containing Dispersion (b) in place of Dispersion (a), Sample B was prepared.

SAMPLE C

In place of Dispersion (a) which was added to the emulsion of Sample A, Dispersion (c), which was prepared by mixing Composition (c-1) and Composition (c-2) (having the compositions described below) and vigorously stirring, was added to the silver halide emulsion as in Sample A.

| | |
|---|---|
| Composition (c-1) | |
| Compound (I-1) | 22 g |
| Compound (II-4) | 7 g |
| Tricresyl Phosphate | 18 g |
| Ethyl Acetate | 25 g |
| Composition (c-2) | |
| Gelatin | 25 g |
| Water | 378 g |
| Saponin (6% aq. soln.) | 25 g |

In the same manner as described in Sample A, except using the emulsion containing Dispersion (c) in place of Dispersion (a), Sample C was prepared.

SAMPLE D

In place of Dispersion (a) which was added to the emulsion of Sample A, Dispersion (d), which was prepared by mixing Composition (d-1) and Composition (d-2) (having the compositions described below) and vigorously stirring, was added to the silver halide emulsion as in Sample A.

| | |
|---|---|
| Composition (d-1) | |
| Compound (III-2) | 17 g |
| Compound (I-1) | 3 g |
| Tricresyl Phosphate | 18 g |
| Ethyl Acetate | 25 g |
| Composition (d-2) | |
| Gelatin | 25 g |
| Water | 387 g |
| Saponin (6% aq. soln.) | 25 g |

In the same manner as described in Sample A, except using the emulsion containing Dispersion (d) in place of Dispersion (a), Sample D was prepared.

SAMPLE E

A sample was prepared in the same manner as described in Sample A, except for coating the emulsion as used in Sample A directly on a subbed support without coating the composition with the antihalation layer.

EXPERIMENT 1

Each of Samples A, B and C described above was exposed for 5 seconds under an optical wedge, developed for 10 seconds at 20° C. using an activator solution having the composition indicated below, and thereafter untanned portions were wiped off in warm water (40° C.) using a sponge, followed by drying.

| Activator Processing Solution | |
|---|---|
| Potassium Carbonate | 25 g |
| Potassium Hydroxide | 7 g |
| Potassium Sulfite | 1 g |
| Potassium Bromide | 0.1 g |
| Water to make | 1 l |

The photographic properties obtained are shown in Table 1.

TABLE 1

| | Relative Sensitivity | Lowest Density at Areas Exposed and Tanning Developed ($D_{min}$) | Maximum Density ($D_{max}$) |
|---|---|---|---|
| Sample A | 100 | 1.40 | 3.40 |
| Sample B | 70 | 1.84 | 3.20 |
| Sample C | 100 | 1.57 | 2.30 |
| Sample E | 100 | 0.60 | 2.80 |

Since the images are generally formed by tanning development in a wash-off film, the developing agent must have not only a high developing activity but also a good tanning property. For example, when a developing agent having a high developing activity to silver halide but a weak tanning property is used, high maximum density is obtained, but a certain portion is washed-off in the areas of high density.

Sample A containing Compound (I), Compound (II) and Compound (III) in combination according to the present invention provided good images having high maximum density and good images in lower density areas. On the contrary, in Sample B containing only Compound (II) and Compound (III), images remained only in areas having high density, and the sensitivity was low. Also, in Sample C, containing only Compound (I) and Compound (II), images remained in areas having higher density than that of Sample A, and the maximum density was low. Furthermore, Sample E which did not have an antihalation layer, provided images having relatively low density. In addition, Sample E was inferior to Sample A in the sharpness of the images.

EXPERIMENT 2

A storage test was performed on Samples A and D. To forcibly age the samples, they were allowed to stand for one day at a temperature of 50° C. and a relative humidity of 70%. Thereafter, the melting time of each silver halide emulsion layer and the degree of stain formation after development were determined. The melting time was determined by immersing the sample in warm water (40° C.) and measuring the time until the emulsion was melted. The results are shown in Table 2.

TABLE 2

| | Melting Time | | Stain | |
|---|---|---|---|---|
| | No Aging | After Aging | No Aging | After Aging |
| Sample A | 20 sec. | 25 sec. | No | No |
| SAmple D | 21 sec. | 15 min. | No | Yes |

As is clear from the results shown in Table 2, Sample A according to the present invention showed no tanning of the emulsion layer by forcible aging nor formation of stain, i.e., Sample A showed excellent storage properties in comparison with Sample D.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon an antihalation layer, a silver halide photographic light-sensitive layer, and a hydrophilic colloid layer, said antihalation layer being located between said support and said silver halide photographic light-sensitive layer, wherein at least one silver halide light-sensitive layer or hydrophilic colloid layer contains a compound represented by the formula (I), a compound represented by the formula (II), and a compound represented by the formula (III)

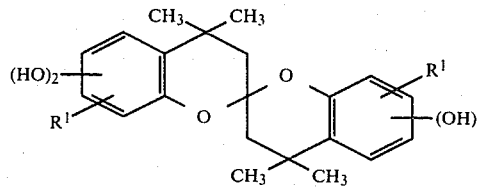

(I)

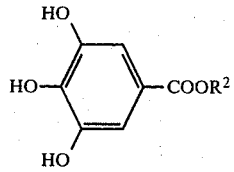

(II)

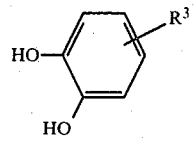

(III)

wherein $R^1$ represents hydrogen or a substituted or unsubstituted alkyl group; $R^2$ represents a substituted or unsubstituted alkyl group; and $R^3$ represents a substituted or unsubstituted alkyl group.

2. A photographic material of claim 1 wherein $R^1$ in the formula (I) is an alkyl group having from 1 to 5 carbon atoms.

3. A photographic material of claim 1 wherein $R^2$ in the formula (II) is an alkyl group having from 2 to 5 carbon atoms.

4. A photographic material of claim 3 wherein $R^2$ is an alkyl group having 3 carbon atoms.

5. A photographic material of claim 1 wherein $R^3$ in the formula (III) is an alkyl group having from 3 to 8 carbon atoms.

6. A photographic material of claim 5 wherein $R^3$ is an alkyl group having from 4 to 6 carbon atoms.

7. A photographic material of claim 1 or 2 wherein the amount of the compound represented by the formula (I) is from about 0.01 to 1 mol/mol Ag.

8. A photographic material of claim 1 or 2 wherein the amount of the compound represented by the formula (I) is from about 0.02 to 0.3 mol/mol Ag.

9. A photographic material of claim 1, 3, or 4 wherein the amount of the compound represented by the formula (II) is from about 0.005 to 0.1 mol/mol Ag.

10. A photographic material of claim 1, 3, or 4 wherein the amount of the compound represented by the formula (II) is from about 0.01 to 0.1 mol/mol Ag.

11. A photographic material of claim 1 wherein the amount of the compound represented by the formula (III) is from about 0.01 to 1 mol/mol Ag.

12. A photographic material of claim 1 wherein the amount of the compound represented by the formula (III) is from about 0.03 to 0.3 mol/mol Ag.

13. A photographic material of claim 1 wherein a compound represented by the formula (I), a compound represented by the formula (II), and a compound represented by the formula (III) are present in the same silver halide photographic light-sensitive emulsion layer.

14. A photographic material of claim 13 wherein said silver halide emulsion layer is provided directly on the antihalation layer.

15. A photographic material of claim 1 wherein the alkyl groups represented by $R^1$ and $R^2$ may be substituted by a chlorine atom, a bromine atom, a hydroxy group, a carboxy group, an alkoxy group or a primary, secondary, or tertiary amino group.

16. A photographic material of claim 1 wherein the alkyl groups represented by $R^3$ may be substituted by a chlorine atom, a bromine atom, a hydroxy group, a carboxy group, an alkoxy group, a sulfo group, an amido group or a primary, secondary, or tertiary amino group.

17. A photographic material of claim 1 or 15 wherein the alkyl groups represented by $R^1$ and $R^2$ may be substituted by a carboxy group, a hydroxy group, a chlorine atom or a bromine atom.

18. A photographic material of claim 1 or 16 wherein the alkyl groups represented by $R^3$ may be substituted by an alkoxy group, a carboxy group, a chlorine atom or a bromine atom.

* * * * *